US010109388B2

(12) United States Patent
Unge et al.

(10) Patent No.: US 10,109,388 B2
(45) Date of Patent: Oct. 23, 2018

(54) DIELECTRIC FLUIDS HAVING REDUCED STREAMER SPEED

(71) Applicant: ABB Research Ltd., Zurich (CH)

(72) Inventors: Mikael Unge, Vasteras (SE); Santanu Singha, Vasteras (SE); Oystein Hestad, Jakobsli (NO); Stian Ingebrigtsen, Soreidgrend (NO); Hans-Sverre Smalo, Oslo (NO); Per-Olof Astrand, Trondheim (NO); Lars Lundgaard, Trondheim (NO); Dag Linhjell, Trondheim (NO)

(73) Assignee: ABB Research Ltd., Zurich (CH)

( * ) Notice: Subject to any disclaimer, the term of this patent is extended or adjusted under 35 U.S.C. 154(b) by 0 days.

(21) Appl. No.: 14/094,253

(22) Filed: Dec. 2, 2013

(65) Prior Publication Data

US 2014/0084226 A1 Mar. 27, 2014

Related U.S. Application Data

(63) Continuation of application No. PCT/EP2012/060302, filed on May 31, 2012.

(60) Provisional application No. 61/492,184, filed on Jun. 1, 2011.

(51) Int. Cl.

| | |
|---|---|
| ***C10M 133/28*** | (2006.01) |
| ***H01B 3/20*** | (2006.01) |
| ***C10M 169/04*** | (2006.01) |

(52) U.S. Cl.

CPC ..... *H01B 3/20* (2013.01); *C10M 133/28* (2013.01); *C10M 169/04* (2013.01); *C10M 2207/2805* (2013.01); *C10M 2207/401* (2013.01); *C10M 2215/06* (2013.01); *C10M 2215/182* (2013.01); *C10N 2240/201* (2013.01)

(58) Field of Classification Search

None

See application file for complete search history.

(56) References Cited

U.S. PATENT DOCUMENTS

| | | | |
|---|---|---|---|
| 6,274,067 | B1 | 8/2001 | Oommen et al. |
| 2002/0027219 | A1 | 3/2002 | Oommen et al. |
| 2002/0049145 | A1 | 4/2002 | Cannon et al. |

(Continued)

FOREIGN PATENT DOCUMENTS

| | | | |
|---|---|---|---|
| EP | 2065459 | A2 | 6/2009 |
| GB | 984723 | A | 3/1965 |

(Continued)

OTHER PUBLICATIONS

Yang, K., et. al.; "Voltage-assisted photoaligning effect of an azo dye doped in a liquid crystal with negative dielectric anisotropy"; Optical Society of America; Sep. 13, 2010, vol. 18, No. 19, Optics Express 19914; pp. 6.

(Continued)

*Primary Examiner* — Necholus Ogden, Jr.

(74) *Attorney, Agent, or Firm* — Whitmyer IP Group LLC

(57) ABSTRACT

The present invention relates to a liquid composition for electrical insulation including a dielectric fluid and an additive, the additive being dissolved in the dielectric fluid and having a 1$^{st}$ excitation energy which is lower than the 1$^{st}$ excitation energy of the dielectric fluid.

10 Claims, 3 Drawing Sheets

(56) References Cited

U.S. PATENT DOCUMENTS

| | | | | |
|---|---|---|---|---|
| 2004/0069975 | A1* | 4/2004 | Corkran et al. | 252/570 |
| 2011/0232940 | A1 | 9/2011 | Hwang et al. | |

FOREIGN PATENT DOCUMENTS

| | | | |
|---|---|---|---|
| WO | 2008071704 | A1 | 6/2008 |
| WO | 2011119747 | A1 | 9/2011 |

OTHER PUBLICATIONS

Chinna Babu P, et al..; "FT-IR, FT-Raman spectra, density functional computations of the vibrational spectra and molecular geometry of butylated hydroxy toluene"; Spectrochimica Acta. Part A: Molecular and Biomolecular Spectroscopy, Mar. 11, 2011 Elsevier, Amsterdam, NL—ISSN 1386-1425; vol. 79, Nr:3, pp. 562-569 (1 page abstract only).

International Preliminary Report on Patent-ability Application No. PCT/EP2012/060302 Completed: Aug. 1, 2013 12 pages.

International Search Report and Written Opinion Application No. PCT/EP2012/060302 Completed: Aug. 2, 2012; Aug. 10, 2012 12 pages.

V, et al.; "Vibrational spectral and quantum chemical investigations of tert-butyl-hydroquinone"; Journal of Molecular Structure, Mar. 1, 2012 Elsevier—ISSN 0022-2860; vol. 1012, pp. 168-176 (1 page abstract only).

Written Opinion of the International Preliminary Examining Authority Application No. PCT/EP2012/060302 dated May 13, 2013 6 pages.

EP Office Action Application No. 12 727 135.1 dated Mar. 9, 2016 6 pages.

G. S. Hartley: "The Cis-form of Azobenzene", Nature, vol. 140, No. 3537, Aug. 14, 1937 (Aug. 14, 1937), pp. 281-281, XP055243669, United Kingdom.

* cited by examiner

DIELECTRIC FLUIDS HAVING REDUCED STREAMER SPEED

TECHNICAL FIELD

The present invention relates to dielectric fluids for electrical and/or power applications, methods for preparing said fluids, electrical and/or power apparatuses comprising said fluids, as well as uses of the dielectric fluids as such.

BACKGROUND

Insulating, dielectric fluids are used in electrical apparatuses like transformers, capacitors, switchgear, bushings, etc., and have a multitude of functions. Dielectric fluids act as electrically insulating medium separating the high voltage and the grounded parts within the apparatus and function as a cooling medium to transfer the heat generated in the current-carrying conductors. Additionally, the fluids provide a medium to monitor the health of a transformer during operation.

In addition to the basic abovementioned functions, the insulating liquid should also comply with other necessary and desired requirements. The fluid should have a high efficiency, long life, and minimal environmental impact. Further, the fluid has to be compatible with the materials used in the electrical equipment and it should not constitute a hazard for the health and safety of personnel. In practice, insulating fluids should fulfil various physical, electrical, and chemical properties and all these properties are regulated through standards and specifications that stipulate the minimum requirements for each one of the important properties.

Traditionally, petroleum-based oils have been used as the insulating fluid in oil-filled transformers mainly because of advantageous properties relating to low viscosity, low pour point, high dielectric strength, easy availability and low cost. During the last couple of decades, the transformer industry has been undergoing several changes. The market demand for compact and efficient transformers with guaranteed long-term performance coupled with the problems of corrosive sulphur and oil quality issues have warranted the need for enhancement in the properties of transformer oil. Further, strict environmental regulations towards health and safety have been steadily evolving and the huge liability risks in the case of transformer fires or outages have raised a cause for concern. Considering these factors, serious research and development efforts have since the 1990 been directed towards identifying alternatives to mineral oil.

Amongst the several options which are generally known, e.g., ester-based fluids, silicone fluid, chlorinated benzenes, perchloroethylene, polyalphaolefins etc., ester based fluids (both synthetic and natural) are excellent alternatives to mineral oil, primarily due to their high biodegradability (lower environmental risk) and high values of flash points and fire points (high fire safety factor). Further, natural esters based on vegetable oils, with the main constituent being triglycerides, are preferred due to their renewability.

There are consequently substantial needs in the art for improving the performance of ester-based fluids, and more specifically triglyceride-based fluids, for power and/or electrical applications, in order to replace the rather disadvantageous insulation fluids currently utilized within the industry.

Generally, all vegetable oils have a high viscosity as compared to mineral oil. If a transformer has to be operated at higher voltage levels, it may occasionally be necessary to circulate the oil inside the transformer through pumps. The high viscosity of vegetable-based liquids then poses several challenges towards the design of the transformer, especially from a cooling point of view. This leads to the requirement of a lower viscosity value for vegetable-based fluids.

Biodegradable natural ester-based fluids have high pour point temperatures as compared to mineral oil, which can be considered as a major drawback if the electrical apparatuses comprising the fluid have to be operated in extremely cold environments, a problem that is especially pronounced at higher voltage ratings. Further, a low pour point can cause changes in the dielectric and/or other properties of the fluid and the solid insulation impregnated with this fluid. This in turn can force design changes in the transformer which can lead to an increase in the manufacturing costs. A very low value of pour point is therefore also desired for the vegetable fluid.

For performing the electrical insulation function, the insulating fluid must be designed to withstand the required electrical stresses as per the design specifications of the electrical apparatus.

Electrical streamers are pre-breakdown phenomena in the form of low-density conductive structures that form in regions of fluid that are over-stressed by electric fields on the order of $1\times10^8$ (V/m) or greater. Once a streamer forms it tends to elongate, growing from the point of initiation towards a grounding point. The extent of a streamer's development depends upon the nature of the electrical excitation which caused it. Sustained over-excitation can result in a streamer bridging the fluid gap between its point of origin and ground. When this happens an arc will form and electrical breakdown will occur. Streamers can form due to both positive and negative excitations (Sullivan, Thesis (Ph. D.), Massachusetts Institute of Technology, Dept. of Electrical Engineering and Computer Science, 2007).

The dielectric breakdown withstand voltage under AC (50/60 Hz) and Lightning Impulse (1.2/50 μs) is considered as the most important parameter from an electrical insulation perspective. The dielectric breakdown withstand voltage (breakdown voltage) can be defined as the voltage required to obtain a flashover in the oil between two electrodes of specified shape and placed at a certain distance from each other. The AC voltage is the line frequency of the mains (either 50 or 60 Hz depending on where you live). The lightning impulse (LI) breakdown voltage is simulating lightning strikes, and usually uses a 1.2 microsecond rise for the wave to reach 90% amplitude then drops back down to 50% amplitude after 50 microseconds. Two technical standards governing how to perform these tests are ASTM D1816 (mainly for AC) and ASTM D3300 (for impulse voltages). The standards specify the type of electrodes and the gap distances required for the tests.

One of the parameters associated with the lightning impulse (LI) breakdown phenomenais the speed at which a streamer propagates from the initiation point to the ground. An important parameter with respect to LI streamer speeds is the acceleration voltage ($V_a$), which can be defined as the voltage at which the speed of the LI streamers accelerates to a very high value.

FIG. 1 generally illustrates a difference in streamer velocity between a natural ester dielectric liquid and mineral oil. The natural ester has an average breakdown voltage ($V_b$) of about 140 kV, beyond which the speed of the streamer is observed to accelerate sharply. So, practically, $V_a$ coincides with $V_b$ in the case of ester liquids, i.e. the ratio of $V_a/V_b$ is close to 1. On the other hand, in the case of mineral oil, the ratio of $V_a/V_b$ is around 1.5 which is much higher. In addition, the breakdown voltage of mineral oil is also higher as compared to the ester liquid.

For a high safety factor in the electrical apparatus, it is always desirable to have a slow streamer speed, i.e. a high breakdown voltage and a higher ratio of $V_a/V_b$. In this respect, ester fluids do not perform similar to traditional mineral oils. Ester dielectric fluids generally have fast LI streamer speeds, typically above 100 km/s (Duy, et al., IEEE Transactions on Dielectrics and Electrical Insulation, 2009, Vol. 16, 6, pp. 1582-1594, and Rongsheng L. et al., IEEE Conference on Electrical Insulation and Dielectric Phenomena, (CEIDP) 2009, 18-21 Oct. 543-548, ISSN: 0084-9162). Therefore, special caution is required in the design of electrical apparatus with ester fluids.

It is known in the art to improve the properties of ester oils used in transformers by the addition of additives. Common additives used for ester oils are anti-oxidants, pour point depressants and metal passivators (see for example U.S. Pat. No. 6,274,067).

Further, in the international patent application WO 2008/071704, an insulation liquid for electrical or electromagnetic devices is disclosed, wherein the liquid comprises a carrier liquid and nano-particles. The nanoparticles preferably have a conductivity of $10^{-5}$ to $10^{5}$ S/cm in order to reduce the streamer speed of a positive streamer.

Also the US patent application US 2011/232940 discloses an insulating liquid that includes an ester liquid and an additive to the ester liquid, whereby a reduction in the formation of fast electrical streamers is allegedly obtained. However, no experimental data is provided supporting this.

There are substantial needs in the art for improving the LI steamer speeds of ester-based dielectric fluids in order to enhance the safety and performance of electrical apparatus used with ester-based dielectric fluids.

SUMMARY

It is an objective of the present invention to provide a dielectric fluid, e.g. an ester-based liquid, for electrical apparatuses, which has a reduced LI streamer speed.

According to an aspect of the present invention, there is provided a liquid composition for electrical insulation comprising a dielectric fluid and an additive, the additive being dissolved in the dielectric fluid and having a $1^{st}$ excitation energy which is lower than the $1^{st}$ excitation energy of the dielectric fluid.

According to another aspect of the present invention, there is provided a method of preparing a liquid composition for electrical insulation comprising a dielectric fluid and an additive, the additive being dissolved in the dielectric fluid and having a $1^{st}$ excitation energy which is lower than the $1^{st}$ excitation energy of the dielectric fluid. The method may comprise the steps of preparing the dielectric fluid comprising a triglyceride having a fatty acid composition of between approximately 10% and approximately 100% fatty acids having at least one carbon-carbon double bond; and adding the additive to the dielectric fluid.

According to another aspect of the present invention, there is provided an apparatus selected from the group consisting of electrical apparatuses and power applications, comprising an embodiment of the composition of the present invention.

According to another aspect of the present invention, there is provided a use of a composition according to the present invention in apparatuses selected from the group of electrical apparatuses and power applications, or in components utilized in electrical apparatuses or power applications.

According to another aspect of the present invention, there is provided a use of a composition according the present invention in components utilized in electrical apparatuses or power applications.

The present invention fulfils the above-identified objective, as it provides a composition comprising a dielectric fluid, e.g. an ester-based fluid, and one or more additives that are able to reduce the LI streamer velocities of the composition. Additionally, the compositions in accordance with the present invention may have a slow LI streamer speed that is comparable to the LI streamer speed of mineral oil.

The present invention pertains to a composition suitable for various power and/or electrical applications, said composition comprising a dielectric, ester-based fluid and an additive, methods for preparing said composition, electrical and/or power apparatuses and components comprising said composition, as well as various uses of said composition.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated. The use of "first", "second" etc. for different features/components of the present disclosure are only intended to distinguish the features/components from other similar features/components and not to impart any order or hierarchy to the features/components.

BRIEF DESCRIPTION OF THE DRAWINGS

The invention is now described, by way of example, with reference to the accompanying drawings, in which.

DETAILED DESCRIPTION

Figure 1:
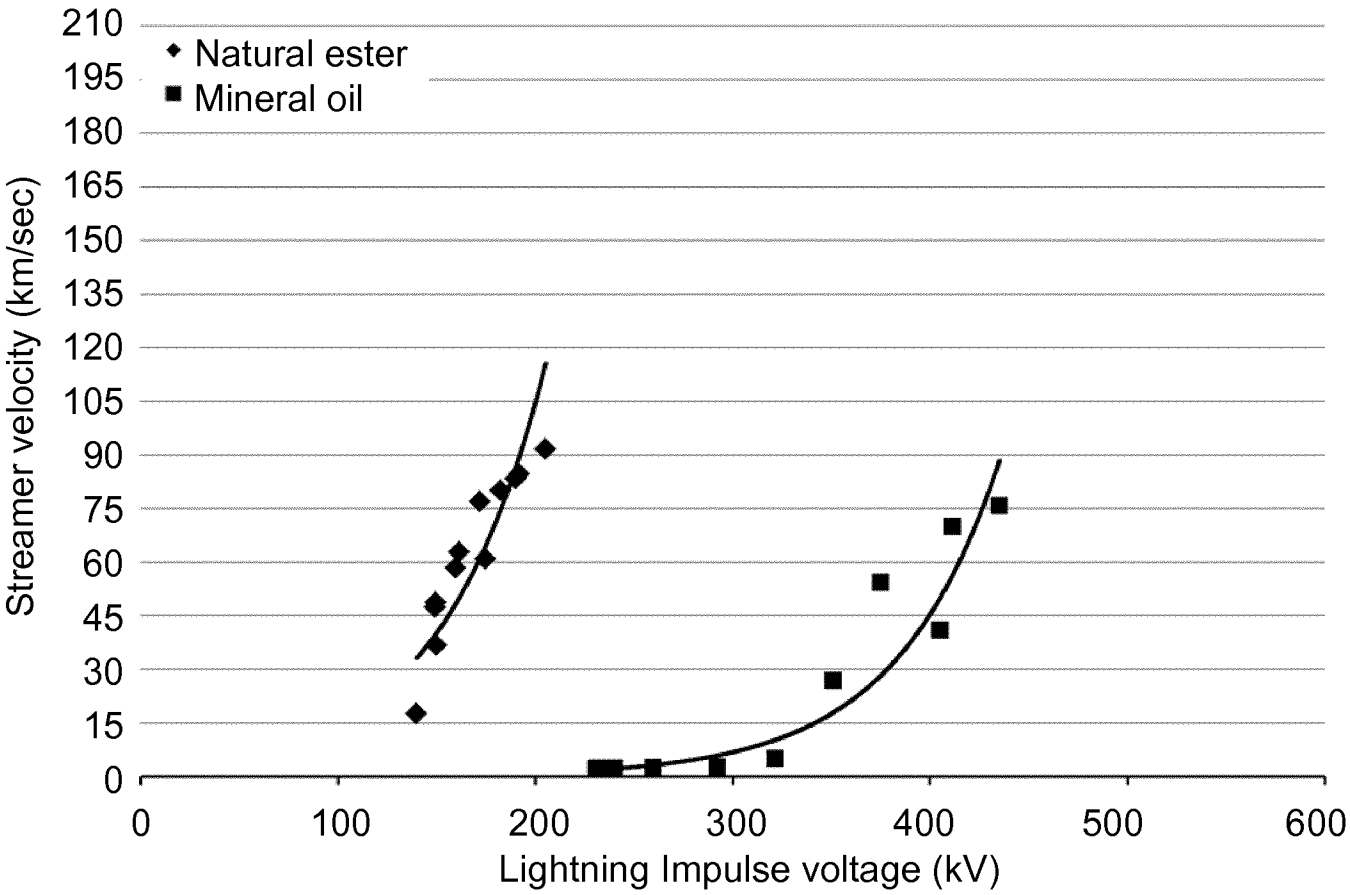
FIG. 1 is an experimental graph presenting a comparison in streamer velocity between a natural ester oil and a mineral oil as a function of applied voltage, of the prior art.

The invention will now be described more fully hereinafter with reference to certain embodiments of the invention. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art.

All words and abbreviations used in the present application shall be construed as having the meaning usually given to them in the relevant art, unless otherwise indicated. For clarity, some terms are however specifically defined below.

The term "fluid" is used herein for the group comprising of oils, emulsions, suspensions and other liquids.

The dielectric fluid of the present invention may be a non-mineral oil, such as a vegetable fluid or oil.

Further, vegetable fluids and/or oils may for instance be selected from the group comprising, but that is not limited to, peanut, rapeseed, castor, olive, corn, cotton, canola, soybean, sesame, linseed, safflower, grapeseed, palm, avocado, pumpkin kernel, macadamia nut, sunflower, and any combinations and/or mixtures thereof. Additionally, fluids and/or oils may be obtained from essentially any organisms being a suitable fluid and/or oil source. Fluids and/or oils derived from animal sources may be selected from the group comprising beef tallow, fish oils, lard, and any combinations and/or mixtures thereof. Naturally, various combinations of the above fluids and/or oils may be utilized, irrespective of the source.

It should be noted that the composition may comprise other additives which are not specifically related to the reduction of streamers, e.g. mixed with or dissolved in the dielectric fluid. Such additives may e.g. be additives for increased oxidation stability or improved pour point of the composition.

In an aspect, the present invention relates to a composition suitable for electrical apparatuses comprising a dielectric fluid, wherein the composition has a slow LI streamer speed that is comparable to mineral oil. The dielectric fluid may be an ester-based dielectric fluid.

In some embodiments of the present invention, the LI streamer speed of the composition is reduced by at least 50%, preferably from 50% up to and including 80%, when compared to the LI streamer speed of any of the commercially available ester-based dielectric oils today, for example triglycerides from rapeseed, soybean and sunflower oils, for a fixed applied test voltage. In yet a further embodiment, the LI streamer speed of the composition is almost similar to the LI streamer speed in mineral oil for the same applied test voltage.

In some embodiments of the present invention, the acceleration voltage ($V_a$) of the composition is increased by at least 25%, when compared to the acceleration voltage of the dielectric fluid without additive, such as any of the commercially available ester-based dielectric oils today, for example triglycerides from rapeseed, soybean and sunflower oils.

In some embodiments of the present invention the composition comprises a dielectric ester-based fluid and one or more additives capable of lowering the LI streamer speed of the fluid. Preferably, the additive is capable to reduce the LI streamer speed of the fluid with at least 50%. More preferably the to additive is capable to reduce the LI streamer speed of the fluid from 50% up to and including 80%, preferably 60-80% or preferably 70-80%. More preferably the additive is capable to reduce the LI streamer speed of the fluid with at least 75%. In some embodiments, the additive is capable of increasing the acceleration voltage of the fluid by at least 25%. More preferably, the additive is capable of increasing the acceleration voltage of the fluid from 25% up to and including 80%, preferably 5-80%. More preferably, the additive is capable of increasing the acceleration voltage of the fluid by at least 75%.

In some embodiments, the breakdown voltage of the composition is increased, often in combination with increased acceleration voltage. The breakdown voltage may e.g. be increased by at least 5% by means of the additive as compared with the dielectric fluid without additive, more preferably by at least 10% or by at least 25%. In some embodiments, the breakdown voltage is increased from 25% up to and including 100%, preferably 50-80%. More preferably, the additive is capable of increasing the breakdown voltage of the fluid by at least 50%, or by at least 75%.

In some embodiments, it is convenient to use a concentration of the additive in the composition of at least 1 wt %, such as between 1 and 10 wt % or between 3 and 8 wt %, e.g. about 5 wt %.

In some embodiments, the additive is a combination of a plurality of different additive compounds, such as the additive compounds "additives" discussed herein.

Suitable additives are able to absorb the energy of the electrons emitted during streamer propagation, without the additive molecule itself getting ionized. This property of the additive molecule helps in reducing the streamer development in the case of LI Voltage or other applied voltage with high enough amplitude to introduce a streamer. Preferably, the additive added to the composition has a lowest or $1^{st}$ electron excitation energy that is lower than the lowest or $1^{st}$ excitation energy of the dielectric fluid. An excited state is obtained if one electron (at least) is excited from its ground state position to an unoccupied energy level. The $1^{st}$ excitation energy is the lowest energy required to move one electron from the ground state configuration to an unoccupied energy level. In some embodiments, the additive has a $1^{st}$ excitation energy of less than 7 eV, such as from 1 to 7 eV, from 1 to 5 eV, or more preferably from 1 to 4 eV.

In one embodiment of the present invention the time to de-excitation of the excited state of the additive is shorter than the time to ionization. In one embodiment, the time to de-excitation of the excited state of the additive is shorter than $10^{-9}$ sec.

As per another embodiment, the time to ionization of the excited state is longer than $10^{-9}$ sec. Ionization from the excited state requires less energy compared to ionization from a molecule in its electronic ground state. A long time to ionization can compensate for long life time of the excited state.

Figure 2:
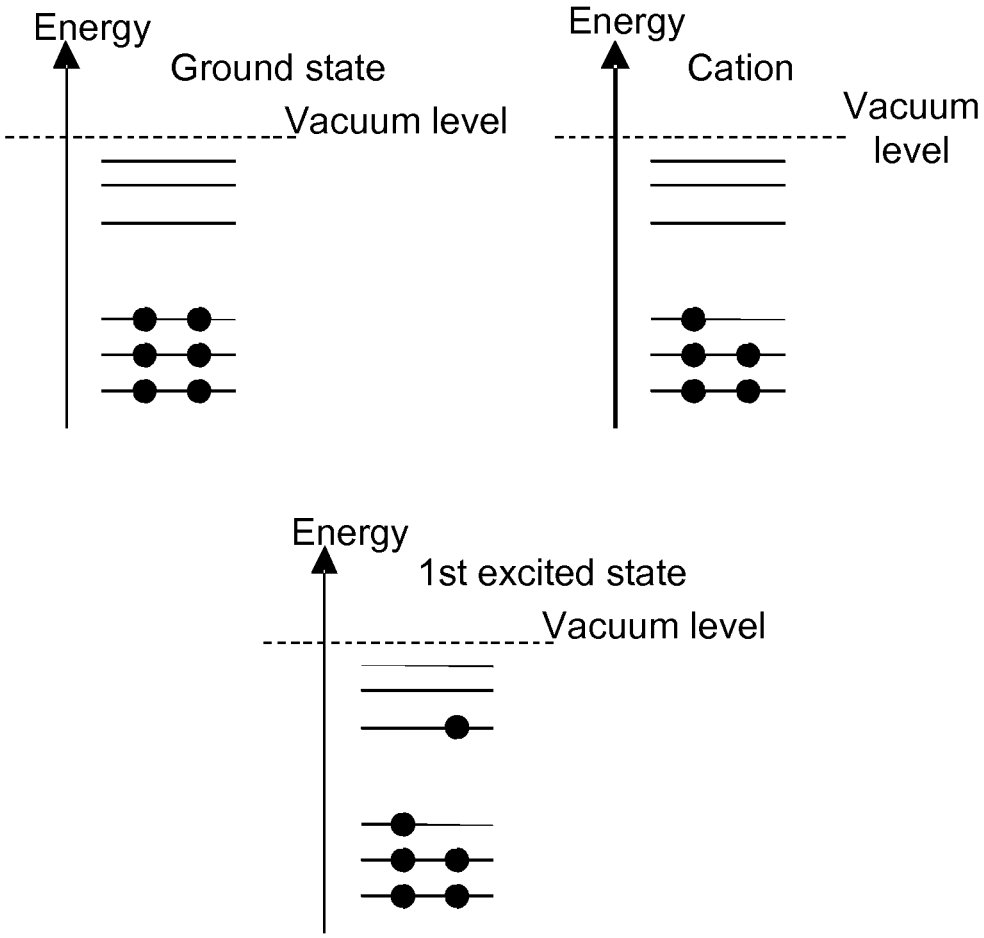
FIG. 2 schematically illustrates the concepts of excitation energy and ionization potential of a compound.

The concepts of $1^{st}$ excitation energy and ionization potential are explained with reference to FIG. 2. A molecule is in its ground state if all electrons are in the lowest possible energy levels, the ground state configuration. A cation is created if an electron is completely removed (above vacuum level). The minimum energy to create a cation is the ionization potential. An excited state is obtained if at least one electron is excited from its ground state position to an unoccupied energy level. The $1^{st}$ excitation energy is the lowest energy required to move one electron from the ground state configuration to an unoccupied energy level. The excited states are unstable and will deexcite after some time.

The additive is dissolvable in the dielectric fluid. Before being added to the insulating liquid composition, the additive may e.g. be in liquid form or in solid, such as particulate, form. If in liquid form, the additive is mixable with the dielectric fluid such that a two-phase liquid system is not formed, and is thus dissolved in the dielectric fluid. If in solid form, the additive is dissolvable in the dielectric fluid such that the additive occur as dissolved, preferably fully dissolved, molecules in the dielectric fluid, and does preferably not occur as particulate matter in a suspension with the dielectric fluid/liquid. However, the composition may also comprise a particulate streamer reducing additive in addition to the dissolved additive, such as nanoparticles e.g. nanoparticles of any of the additive compounds discussed herein.

Suitable additives include dimethyl aniline (DMA) or are selected from the group consisting of azo compounds or color dyes, such as triarylmethane dyes, cyanines and quinone-imine dyes. Further examples of color dyes suitable as additives are selected from the group consisting of alcian yellow GXS, alizarin, alizarin red S, alizarin yellow GG, alizarin yellow R, azophloxin, bismarck brown R, bismarck brown Y, brilliant cresyl blue, chrysoidine R, chrysoidine Y, congo red, crystal violet, fuchsin acid, gentian violet, janus green, lissamine fast yellow, martius yellow, meldola blue, metanil yellow, methyl orange, methyl red, naphthalene black 12B, naphthol green B, naphthol yellow S, orange G, rose bengal, sudan II, titan yellow, tropaeolin O, tropaeolin OO, tropaeolin OOO, victoria blue 4R, victoria blue B, victoria blue R, and xylene cyanol FF. In some embodiments, the additive is selected from transitional metal compounds, such as oxides and carbo monoxides of transition metals. Examples of transition metal compounds are $MnO_4^-$, $Mn_2(CO)_{10}$ and $Ni(CO)_4$.

The term "transition metals" as used herein denotes the elements in group 3 to 12 of the periodic table. Examples of transition metals are titanium, vanadium, chromium, manganese, iron, cobalt, nickel, copper, zinc, silver, cadmium, tungsten, iridium and gold.

In this specification the term "alkyl" includes both straight and branched chain alkyl groups, but references to individual alkyl groups such as "propyl" are specific for the straight chain version only. For example, "$C_{1-6}$alkyl" includes $C_{1-4}$alkyl, $C_{1-3}$alkyl, propyl, isopropyl and t-butyl. However, references to individual alkyl groups such as 'propyl' are specific for the to straight chained version only and references to individual branched chain alkyl groups such as 'isopropyl' are specific for the branched chain version only. A similar convention applies to other radicals, for example "phenyl-$C_{1-6}$alkyl" would include phenyl-$C_{1-4}$ alkyl, benzyl, 1-phenylethyl and 2-phenylethyl. Alkyl groups may be optionally substituted as defined herein. Examples of alkyl groups include methyl, ethyl, n-propyl, isopropyl, n-butyl, isobutyl, sec-butyl, tert-butyl, pentyl, iso-amyl, hexyl, octyl, noyl and the like. The term "alkylene," as used herein, alone or in combination, refers to a saturated aliphatic group derived from a straight or branched chain saturated hydrocarbon attached at two or more positions, such as methylene (—$CH_2$—). Unless otherwise specified, the term "alkyl" may include "alkylene" groups.

The term "halo" refers to fluoro, chloro, bromo and iodo.

Where optional substituents are chosen from "one or more" groups it is to be understood that this definition includes all substituents being chosen from one of the specified groups or the substituents being chosen from two or more of the specified groups.

The term "acyl," as used herein, alone or in combination, refers to a carbonyl attached to an alkenyl, alkyl, aryl, cycloalkyl, heteroaryl, heterocycle, or any other moiety were the atom attached to the carbonyl is carbon. An "acetyl" group refers to a —C(O)$CH_3$ group. An "alkylcarbonyl" or "alkanoyl" group refers to an alkyl group attached to the parent molecular moiety through a carbonyl group. Examples of such groups include methylcarbonyl and ethylcarbonyl. Examples of acyl groups include formyl, alkanoyl and aroyl.

The term "alkenyl," as used herein, alone or in combination, refers to a straight-chain or branched-chain hydrocarbon group having one or more double bonds and containing from 2 to 20 carbon atoms. In certain embodiments, said alkenyl will comprise from 2 to 6 carbon atoms. The term "alkenylene" refers to a carbon-carbon double bond system attached at two or more positions such as ethenylene [(—CH═CH—),(—C═C—)]. Examples of suitable alkenyl groups include ethenyl, propenyl, 2-methylpropenyl, 1,4-butadienyl and the like. Unless otherwise specified, the term "alkenyl" may include "alkenylene" groups.

The term "alkoxy," as used herein, alone or in combination, refers to an alkyl ether group, wherein the term alkyl is as defined below. Examples of suitable alkyl ether groups include methoxy, ethoxy, n-propoxy, isopropoxy, n-butoxy, iso-butoxy, sec-butoxy, tert-butoxy, and the like.

The term "alkylamino," as used herein, alone or in combination, refers to an alkyl group attached to the parent molecular moiety through an amino group. Suitable alkylamino groups may be mono- or dialkylated, forming groups such as, for example, N-methylamino, N-ethylamino, N,N-dimethylamino, N,N-ethylmethylamino and the like.

The term "alkylidene," as used herein, alone or in combination, refers to an alkenyl group in which one carbon atom of the carbon-carbon double bond belongs to the moiety to which the alkenyl group is attached.

The term "alkylthio," as used herein, alone or in combination, refers to an alkyl thioether (R—S—) group wherein the term alkyl is as defined above and wherein the sulfur may be singly or doubly oxidized. Examples of suitable alkyl thioether groups include methylthio, ethylthio, n-propylthio, isopropylthio, n-butylthio, iso-butylthio, sec-butylthio, tert-butylthio, methanesulfonyl, ethanesulfinyl, and the like.

The term "alkynyl," as used herein, alone or in combination, refers to a straight-chain or branched chain hydrocarbon group having one or more triple bonds and containing from 2 to 20 carbon atoms. In certain embodiments, said alkynyl comprises from 2 to 6 carbon atoms. In further embodiments, said alkynyl comprises from 2 to 4 carbon atoms. The term "alkynylene" refers to a carbon-carbon triple bond attached at two positions such as ethynylene (—C:::C—, —C≡C—). Examples of alkynyl groups include ethynyl, propynyl, hydroxypropynyl, butyn-1-yl, butyn-2-yl, pentyn-1-yl, 3-methylbutyn-1-yl, hexyn-2-yl, and the like. Unless otherwise specified, the term "alkynyl" may include "alkynylene" groups.

The terms "amido" and "carbamoyl," as used herein, alone or in combination, refer to an amino group as described below attached to the parent molecular moiety through a carbonyl group, or vice versa. The term "C-amido" as used herein, alone or in combination, refers to a —C(═O)—$NR_2$ group with R as defined herein. The term "N-amido" as used herein, alone or in combination, refers to a RC(═O)NH— group, with R as defined herein. The term "acylamino" as used herein, alone or in combination, embraces an acyl group attached to the parent moiety through an amino group. An example of an "acylamino" group is acetylamino ($CH_3$C(O)NH—).

The term "aryl" as used herein refers to a totally unsaturated, monocyclic, bicyclic or tricyclic carbon ring system containing 3-14 ring atoms, wherein such polycyclic ring systems are fused together. Preferably "aryl" is a monocyclic ring containing 5 or 6 atoms or a bicyclic ring containing 9 or 10 atoms. Suitable values for "aryl" include, but are not limited to phenyl, naphthyl, anthracenyl, and phenanthryl. Particularly "aryl" is phenyl.

A "heteroaryl" as used herein as used herein, alone or in combination, refers to an unsaturated heteromonocyclic ring, or a fused monocyclic, bicyclic, or tricyclic ring system in which at least one of the fused rings is aromatic, containing 3 to 14 ring atoms of which at least one atom selected from the group consisting of oxygen sulphur or nitrogen. In certain embodiments, "heteroaryl" refers to a monocyclic ring containing 5 or 6 atoms or a bicyclic ring containing 8, 9 or 10 atoms of which at least one atom is chosen from nitrogen, sulphur or oxygen. The term also embraces fused polycyclic groups wherein heterocyclic rings are fused with aryl rings, wherein heteroaryl rings are fused with other heteroaryl rings, wherein heteroaryl rings are fused with heterocycloalkyl rings, or wherein heteroaryl rings are fused with cycloalkyl rings. Examples of heteroaryl groups include pyrrolyl, pyrrolinyl, imidazolyl, pyrazolyl, pyridyl, pyrimidinyl, pyrazinyl, pyridazinyl, triazolyl, pyranyl, furyl, thienyl, oxazolyl, isoxazolyl, oxadiazolyl, thiazolyl, thiadiazolyl, isothiazolyl, indolyl, isoindolyl, indolizinyl, benzimidazolyl, quinolyl, isoquinolyl, quinoxalinyl, quinazolinyl, indazolyl, benzotriazolyl, benzodioxolyl, benzopyranyl, benzoxazolyl, benzoxadiazolyl, benzothiazolyl, benzothiadiazolyl, benzofuryl, benzothienyl, chromonyl, coumarinyl, benzopyranyl, tetrahydroquinolinyl, tetrazolopyridazinyl, tetrahydroisoquinolinyl, thienopyridinyl, furopyridinyl, pyrrolopyridinyl and the like. Exemplary tricyclic heterocyclic groups include carbazolyl, benzidolyl, phenanthrolinyl, dibenzofuranyl, acridinyl, phenanthridinyl, xanthenyl and the like.

The term "heterocyclyl", as used herein, refers to a saturated, partially saturated or partially unsaturated, or fully unsaturated, monocyclic, bicyclic or tricyclic ring system containing at least one ring atom chosen from nitrogen, sulphur or oxygen, which may, unless otherwise specified, be carbon or nitrogen linked, wherein a —$CH_2$— group can optionally be replaced by a —C(O)— or a ring sulphur atom may be optionally oxidised to form the S-oxides. Preferably a "heterocyclyl" is a saturated, partially saturated or fully unsaturated, mono or bicyclic ring containing 5 or 6 atoms of which at least one atom is chosen from nitrogen, sulphur or oxygen, which may, unless otherwise specified, be carbon or nitrogen linked, wherein a —$CH_2$— group can optionally be replaced by a —C(O)— or a ring sulphur atom may be optionally oxidised to form S-oxide(s). Heterocycloalkyl" and "heterocycle" are intended to include sulfones, sulfoxides, N-oxides of tertiary nitrogen ring members, and carbocyclic fused and benzo fused ring systems; additionally, both terms also include systems where a heterocycle ring is fused to an aryl group, as defined herein, or an additional heterocycle group. Examples of heterocycle groups include aziridinyl, azetidinyl, 1,3-benzodioxolyl, dihydroisoindolyl, dihydroisoquinolinyl, dihydrocinnolinyl, dihydrobenzodioxinyl, dihydro[1,3]oxazolo[4,5-b]pyridinyl, benzothiazolyl, dihydroindolyl, dihydropyridinyl, 1,3-dioxanyl, 1,4-dioxanyl, 1,3-dioxolanyl, isoindolinyl, morpholinyl, piperazinyl, pyrrolidinyl, tetrahydropyridinyl, piperidinyl, thiomorpholinyl, and the like. The heterocycle groups may be optionally substituted unless specifically prohibited.

A "carbocyclyl" is a saturated, partially saturated or unsaturated, mono or bicyclic carbon ring that contains 3-12 atoms; wherein a —$CH_2$— group can optionally be replaced by a —C(O)—. Preferably "carbocyclyl" is a monocyclic ring containing 5 or 6 atoms or a bicyclic ring containing 9 or 10 atoms. Suitable values for "carbocyclyl" include cyclopropyl, cyclobutyl, 1-oxocyclopentyl, cyclopentyl, cyclopentenyl, cyclohexyl, cyclohexenyl, phenyl, naphthyl, tetralinyl, indanyl or 1-oxoindanyl. Particularly "carbocyclyl" is cyclopropyl, cyclobutyl, 1-oxocyclopentyl, cyclopentyl, cyclopentenyl, cyclohexyl, cyclohexenyl, phenyl or 1-oxoindanyl.

An example of "$C_{1-6}$alkanoyloxy" and "$C_{1-4}$alkanoyloxy" is acetoxy. Examples of "$C_{1-6}$alkoxycarbonyl" and "$C_{1-4}$alkoxycarbonyl" include methoxycarbonyl, ethoxycarbonyl, n- and t-butoxycarbonyl. Examples of "$C_{1-6}$alkoxy" and "$C_{1-4}$alkoxy" include methoxy, ethoxy and propoxy. Examples of "$C_{1-6}$alkanoylamino" and "$C_{1-4}$alkanoylamino" include formamido, acetamido and propionylamino. Examples of "$C_{1-6}$alkylS(O)$_a$ wherein a is 0 to 2" and "$C_{1-4}$alkylS(O)$_a$ wherein a is 0 to 2" include methylthio, ethylthio, methylsulphinyl, ethylsulphinyl, mesyl and ethylsulphonyl. Examples of "$C_{1-6}$alkanoyl" and "$C_{1-4}$alkanoyl" include $C_{1-3}$alkanoyl, propionyl and acetyl. Examples of "N—($C_{1-6}$alkyl)amino" and "N—($C_{1-4}$alkyl)amino" include methylamino and ethylamino. Examples of "N,N—($C_{1-6}$alkyl)$_2$-amino" and "N,N—($C_{1-4}$alkyl)$_2$-amino" include di-N-methylamino, di-(N-ethyl)amino and N-ethyl-N-methylamino. Examples of "$C_{2-6}$alkenyl" and "$C_{2-4}$alkenyl" are vinyl, allyl and 1-propenyl. Examples of "$C_{2-6}$alkynyl" and "$C_{2-4}$alkynyl" are ethynyl, i-propynyl and 2-propynyl. Examples of "N—($C_{1-6}$alkyl)sulphamoyl" and "N—($C_{1-4}$alkyl)sulphamoyl" are N—($C_{1-3}$alkyl)sulphamoyl, N-(methyl)sulphamoyl and N-(ethyl)sulphamoyl. Examples of "N—($C_{1-6}$alkyl)$_2$sulphamoyl" and "N—($C_{1-4}$alkyl)$_2$sulphamoyl" are N,N-(dimethyl)sulphamoyl and N-(methyl)-N-(ethyl)sulphamoyl. Examples of "N—($C_{1-6}$alkyl)carbamoyl" and "N—($C_{1-4}$alkyl)carbamoyl" are methyl aminocarbonyl and ethylaminocarbonyl. Examples of "N,N—($C_{1-6}$alkyl)$_2$-carbamoyl" and "N,N—($C_{1-4}$alkyl)$_2$-carbamoyl" are dimethylaminocarbonyl and methylethylaminocarbonyl. Examples of "$C_{1-6}$alkoxycarbonylamino" are ethoxycarbonylamino and t-butoxycarbonylamino. Examples of "N'—($C_{1-6}$alkyl)ureido" are N'-methylureido and N'-ethylureido. Examples of "N—($C_{1-6}$alkyl)ureido are N-methylureido and N-ethylureido. Examples of "N',N'—($C_{1-6}$alkyl)$_2$ureido are N',N'-dimethylureido and N'-methyl-N'-ethylureido. Examples of "N'—($C_{1-6}$alkyl)-N—($C_{1-6}$alkyl)ureido are N'-methyl-N-methylureido and N'-propyl-N-methylureido. Examples of "N',N'—($C_{1-6}$alkyl)$_2$-N—($C_{1-6}$alkyl)ureido are N',N'-dimethyl-N-methylureido and N'-methyl-N'-ethyl-N-propylureido.

Examples of "triarylmethane dyes" include methyl violet dyes, fuchsine dyes, phenol dyes and different bridged arenes.

Examples of "methyl violet dyes" include methyl violet 2B, methyl violet 6B and methyl violet 10B (hexamethyl pararosaniline chloride).

Examples of "fuchsine dyes" include pararosaniline ([4-[Bis(4-aminophenyl)methylidene]-1-cyclohexa-2,5-dienylidene]azanium chloride), fuchsine (4-[(4-Aminophenyl)-(4-imino-1-cyclohexa-2,5-dienylidene) methyl]aniline hydrochloride), new fuchsine and fuchsine acid.

Examples of "phenol dyes" include phenol red (phenolsulfonphthalein), chlorophenol red (2-chloro-4-[3-(3-chloro-4-hydroxyphenyl)-1,1-dioxobenzo[c]oxathiol-3-yl] phenol) and cresol red (o-cresolsulfonephthalein).

In this specification the term "bridged arenes" includes acridines, xanthenes, thioxanthenes, and derivatives thereof.

Examples of "cyanine dyes" include streptocyanines or open chain cyanines, hemicyanines, or closed chain cyanines of the following formulas $$R'R''N^{+}{=}CH[CH{=}CH]_n{-}NR'R'',$$

$$Aryl{=}N^{+}{=}CH[CH{=}CH]_n{-}NR'R'', \text{ and}$$

$$Aryl{=}N^{+}{=}CH[CH{=}CH]_n{-}N{=}Aryl,$$

wherein the two nitrogens are joined by a polymethine chain, ={CH[CH=CH]$_n$, and both nitrogens are each independently part of a heteroaromatic moiety. Examples of closed chain cyanines are Cy3 and Cy5.

Examples of "quinone-imine dyes" include the groups selected from indamins; indophenols; azins, including the subgroups of eurhodins, safranins and indulines; oxazins, including gallocyanin, gallamin blue and celestin blue B; and thiazins, including methylene blue homologues.

In some embodiments, the additive(s) used in the composition herein is selected from azo compounds, of formula (I)

$$R^5—N=N—R^6 \quad (I)$$

wherein $R^5$ and $R^6$ are both independently selected from aryl or heteroaryl, which is unsubstituted or substituted in one, two or three positions with substituents independently selected from $C_{1-10}$ alkyl, $C_{2-10}$ alkenyl, $C_{2-10}$ alkynyl, OH, CHO, $C_{1-10}$ acyl, $C_{1-10}$ alkoxy, $C_{1-6}$alkanoyloxy, $C_{1-10}$ alkylthio, $C_{1-10}$ alkylamino, CN, nitro, amino, amido, sulfonyl, arylsulfonyl, halo, halo $C_{1-10}$ alkyl, $C_{1-10}$ alkyl aryl, and aminoaryl; or a five-membered carbocyclic or heterocylic ring, which is unsubstituted or substituted in one, two or three positions with substituents independently selected from $C_{1-10}$ alkyl, $C_{2-10}$ alkynyl, OH, CHO, $C_{1-10}$ acyl, $C_{1-10}$ alkoxy, $C_{1-6}$alkanoyloxy, $C_{1-10}$ alkylthio, $C_{1-10}$ alkylamino, CN, nitro, amino, arylamino, amido, sulfonyl, arylsulfonyl, halo, halo-$C_{1-10}$ alkyl $C_{1-10}$ alkyl aryl, and aminoaryl.

In some embodiments, $R^5$ and $R^6$ are each independently selected from the group consisting of phenyl, furyl, thiophenyl, pyrrolyl, oxazolyl, thiazolyl, imidazolyl and furan; wherein $R^5$ and $R^6$, each independently may be unsubstituted or substituted in one or two positions with OH, $N(R^7)_2$, $NO_2$, sulfonyl, or anilino, and wherein $R^7$ is selected from H, or $C_{1-6}$-alkyl, preferably H.

In some embodiments, $R^5$ is selected from phenyl, 2-oxazolyl, 2-thiazolyl and 2-imidazolyl; and $R^6$ is selected from furyl, pyrrolyl, thiophenyl, 2-oxazolyl, 2-imidazolyl, 2-thiazolyl, phenyl, benzofuryl, indolyl, and benzothiophene;

wherein $R^5$ and $R^6$ are each independently unsubstituted or substituted in one or two positions with H, $C_{2-10}$ alkenyl, $C_{2-10}$ alkynyl, OH, CHO, $C_{1-10}$ acyl, $C_{1-10}$ alkoxy, $C_{1-6}$alkanoyloxy, $C_{1-10}$ alkylthio, halo, halo $C_{1-10}$ alkyl, $C_{1-10}$ alkyl aryl, $N(R^7)_2$, $NO_2$, CN, amino, amido, sulfonyl, arylsulfonyl, and aminoaryl, wherein $R^7$ is selected from H, or $C_{1-10}$-alkyl, preferably H.

In some embodiments, $R^5$ is selected from phenyl, 2-oxazolyl, 2-thiazolyl and 2-imidazolyl; and $R^6$ is selected from phenyl and 2-thiazolyl, wherein $R^5$ and $R^6$ are each independently unsubstituted or substituted in one or two positions with OH, $N(R^7)_2$, $NO_2$, sulfonyl, or anilino, wherein $R^7$ is selected from H, or $C_{1-6}$-alkyl, preferably H.

In some embodiments, the additive(s) is selected from the group of azo compounds having one of the following formulas (II), (III) and (IV), (II)

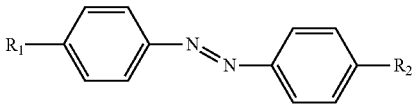

(III)

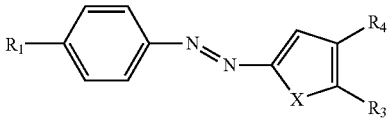

-continued (IV)

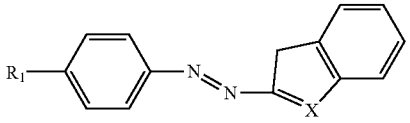

wherein

X is selected from S, O and N; and $R_1$, $R_2$, $R_3$, and $R_4$, are each independently selected from H, $C_{2-10}$ alkenyl, $C_{2-10}$ alkynyl, OH, CHO, $C_{1-10}$ acyl, $C_{1-10}$ alkoxy, $C_{1-6}$ alkanoyloxy, $C_{1-10}$ alkylthio, $C_{1-10}$ alkylamino, CN, nitro, amino, amido, sulfonyl, arylsulfonyl, halo, halo $C_{1-10}$ alkyl, $C_{1-10}$ alkyl aryl, and aminoaryl.

In some embodiments,

X is selected from S and O;

$R_1$ is selected from H, $C_{1-10}$ alkyl, OH, $C_{1-10}$-alkoxy, CN, and $NH_2$;

$R_2$ is selected from H or CN;

$R_3$ is selected from H, CHO, $CH=CH_2$; and $R_4$ is selected from H, OH and halo.

In some embodiments, $R_1$ is selected from H, $C_{1-4}$-alkyl, OH, $C_{1-4}$-alkoxy, CN, and $NH_2$;

$R_2$ is selected from H or CN;

$R_3$ is selected from H, CHO, $CH=CH_2$; and $R_4$ is selected from H and Cl.

In some embodiments, $R_1$ is selected from H, $CH_3$, OH, $OCH_3$, CN, and $NH_2$;

$R_2$ is selected from H or CN;

$R_3$ is selected from H, CHO, $CH=CH_2$; and $R_4$ is selected from H and Cl.

In some embodiments, suitable additive(s) is of the following formula (V)

(V)

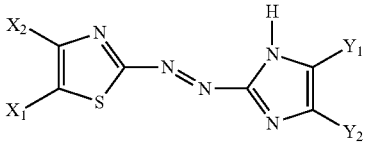

wherein $X_1$, $X_2$, $Y_1$ and $Y_2$ are each independently selected from H, $C_{1-10}$ alkyl, $C_{2-10}$ alkenyl, $C_{2-10}$ alkynyl, OH, CHO, $C_{1-10}$ acyl, $C_{1-10}$ alkoxy, $C_{1-6}$ alkanoyloxy, $C_{1-10}$ alkylthio, $C_{1-10}$ alkylamino, CN, nitro, amino, amido, sulfonyl, arylsulfonyl, halo, halo $C_{1-10}$ alkyl, $C_{1-10}$ alkyl aryl, and aminoaryl.

Preferably, $X_1$ and $X_2$ are each independently selected from H, $C_{1-6}$ alkyl, CHO, $NO_2$, $NH_2$, and CN; and $Y_1$ and $Y_2$ are each independently selected from H, $C_{1-6}$ alkyl, CHO, OH, $NH_2$, and CN.

In some embodiments, $X_1$ and $X_2$ are each independently is selected from H, $NO_2$, $NH_2$, and CN $X_2$ is selected from H, $NH_2$, and CN;

$Y_1$ is selected from H, OH, $NH_2$, and CN; and $Y_2$ is selected from H, OH, $NH_2$, and CN In some embodiments, the additive is selected from 4-anilino-4'-nitroazobenzene and p-dimethylamino-azobenzenesulfonic acid.

In some embodiments of the present invention the dielectric fluid is an ester-based fluid such as an ester oil, preferably a triglyceride oil.

In some embodiments, the dielectric, ester-based fluid has a fatty acid composition of between approximately 10% and approximately 100% fatty acids having at least one carbon-carbon double bond.

The fatty acids may be of essentially any length, having essentially any number of unsaturations, either conjugated and/or unconjugated. Fatty acids may for instance be selected from the group comprising, but not limited to, oleic acid, linoleic acid, α-linolenic acid, myristoleic acid, arachidonic acid, icosapentaenoic acid, palmitoleic acid, erucic acid, and docosahexaenoic acid, butyric acid, caproic acid, caprylic acid, capric acid, lauric acid, myristic acid, palmitic acid, stearic acid, vaccenic acid, gamma-linolenic acid, behenic acid, erucic acid, lignoceric acid, or any other fatty acids, suitably modified, if needed, in accordance with the requirements of the present invention.

In an aspect, the present invention pertains to a method for preparing a composition suitable for electrical apparatuses, such as transformers. The composition may comprise a dielectric fluid (e.g. an ester-based fluid).

In some embodiments, the method for providing the composition comprising a dielectric, ester-based fluid comprises the steps of providing a triglyceride composition having a fatty acid composition of between approximately 10% and approximately 100% fatty acids having at least one carbon-carbon double bond.

In some embodiments, the method for providing the composition comprising a dielectric ester-based fluid comprises the steps of providing a triglyceride composition having a fatty acid composition of between approximately 10% and approximately 100% fatty acids having at least one carbon-carbon double bond, wherein the at least one carbon-carbon double bond is subsequently reacted with at least one conjugated diene, normally in the presence of a catalyst, resulting in the formation of said dielectric, triglyceride fluid.

In an aspect, the present invention relates to an apparatus selected from the group consisting of electrical apparatuses and power applications, comprising a composition of the present invention. Preferably, the apparatus comprises a composition comprising a dielectric, ester-based fluid. More preferably, the apparatus comprises a composition that has a slow LI streamer speed that is comparable to mineral oil.

In some embodiments, the electrical and/or power apparatus comprises a composition of the present invention, wherein said composition functions as an insulating medium.

In some embodiments, the electrical and/or power apparatus comprising a composition of the present invention is selected from transformers, capacitors, switchgear, bushings, etc., as well components and/or parts utilized in power or electrical applications.

In some embodiments, the electrical apparatus is a transformer.

In an aspect, the present invention pertains to various uses of a composition of the present invention, in electrical apparatuses, and/or in apparatuses for power applications, and/or in components utilized in said apparatuses, wherein the composition comprises a dielectric, ester based fluid and has a slow LI streamer speed that is comparable to mineral oil. Apparatuses of interest as per the present invention may for instance be transformers, capacitors, switchgear, bushings, etc., as well components and/or parts utilized in power or electrical applications.

The excited state of the additive may be determined with spectroscopy and/or calculations using quantum chemistry. The excited states of the additive is not expected to change when dissolved in the dielectric ester-based fluid.

Example 1

N,N-dimethyl aniline, DMA, (Formula VI) was added to a natural ester dielectric to form a composition of the present invention.

(VI)

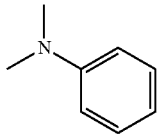

N,N-dimethylaniline

Figure 3:
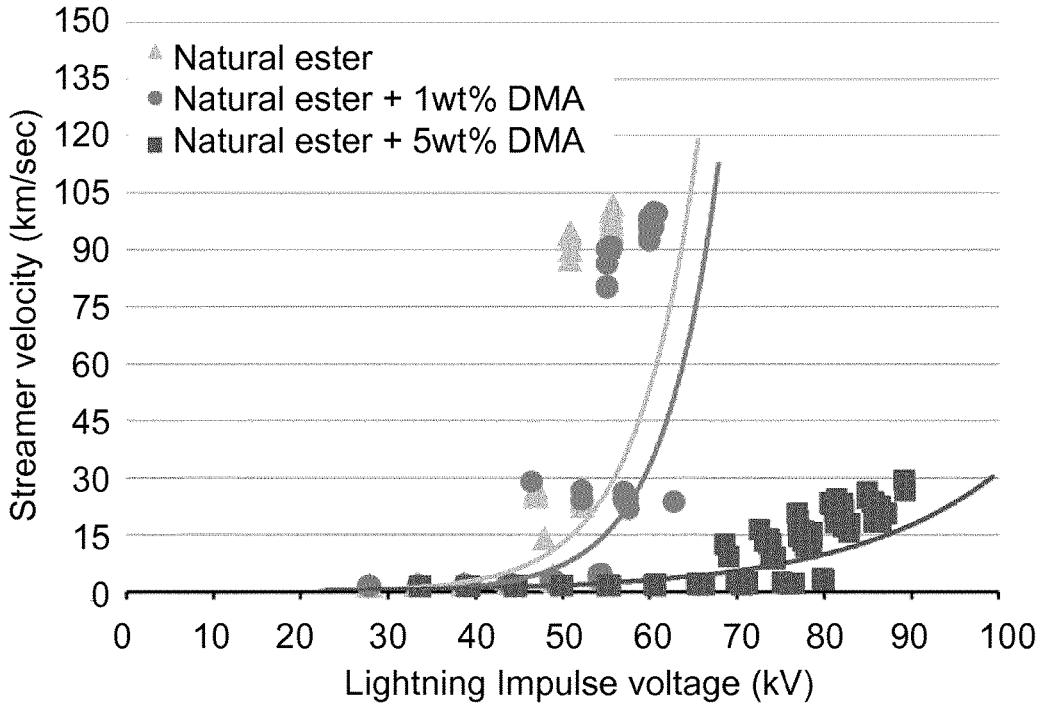
FIG. 3 is an experimental graph presenting a comparison in streamer velocity between a natural ester oil and the same ester oil comprising an additive according to the present invention.

The natural ester had an ionization potential (vertical) of 8.50 electron volts (eV), and a first excitation energy of 5.30 eV. DMA has an ionization potential (vertical) of 7.42 eV and a first excitation energy of 4.03 eV. Three different samples were prepared: the natural ester without the additive DMA, the natural ester with 1 wt % DMA and the natural ester with 5 wt % DMA. As can be seen in FIG. 3, the acceleration voltage is increased by about 10% with 1 wt % DMA and with about 80% with 5 wt % DMA. The streamer velocity is thus significantly reduced, especially with 5% additive but also with only 1% additive.

Example 2 trans-Azobenzene (Formula VII) was added to a natural ester dielectric to form a composition of the present invention.

(VII)

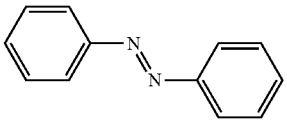

trans-azobenzene

Figure 4:
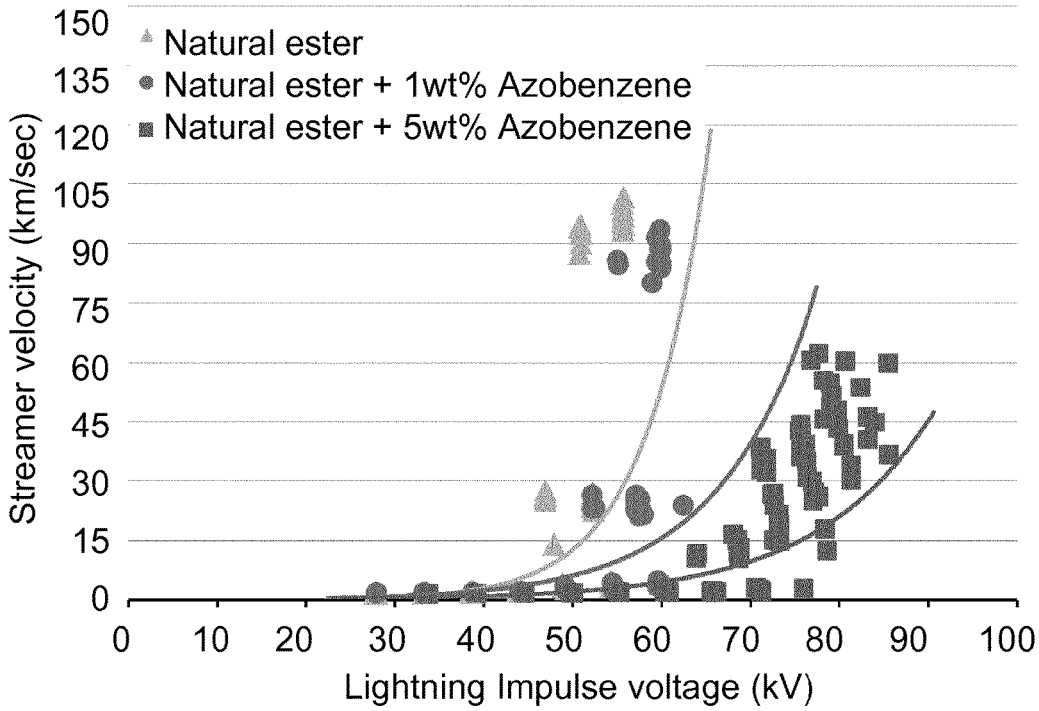
FIG. 4 is an experimental graph presenting a comparison in streamer velocity between a natural ester oil and the same ester oil comprising another additive according to the present invention.

The natural ester had an ionization potential (vertical) of 8.50 eV, and a first excitation energy of 5.30 eV. Azobenzene has an ionization potential (vertical) of 7.82 eV and a first excitation energy of 2.29 eV. Three different samples were prepared: the natural ester without the additive azobenzene, the natural ester with 1 wt % azobenzene and the natural ester with 5 wt % azobenzene. As can be seen in FIG. 4, the acceleration voltage is increased by about 10% with 1 wt % azobenzene and with about 50% with 5 wt % azobenzene. The streamer velocity is thus significantly reduced, especially with 5% additive but also with only 1% additive.

Example 3

Examples of additives which may conveniently be used according to the present invention include:
compounds with P═N double bonds (VIII)

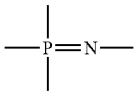

for example N-(Triphenylphosphoranylidene)aniline (IX)

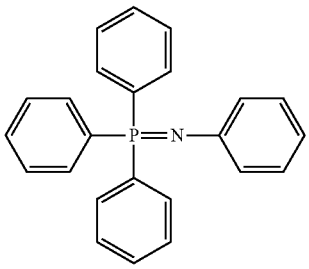

;

pigments, for example tetraphenylcyclopentadienone (X)

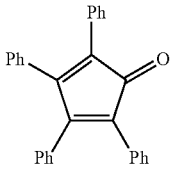

or N-ethyl-1-(4-(phenylazo)phenylazo)-2-naphthylamine (XI)

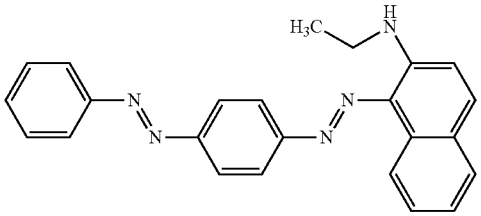

;

other compounds with aromatic groups, e.g. below (XII)

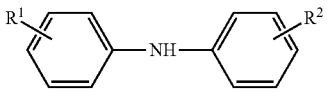

where $R_1$ and $R_2$ are alkyl chains;
flavonoids, for example quercetin (XIII)

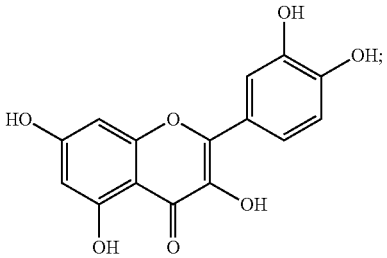

and compounds with furan substructure, for example furyl acrylic acid (XIV)

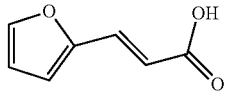

or 2-acetyl furan (XV)

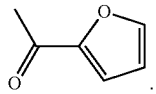

.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. An apparatus selected from the group consisting of electrical apparatuses and power applications, comprising a liquid electrically insulating composition comprising a dielectric fluid and an additive in a concentration of between 1 and 10 wt % of the composition, wherein the additive is dissolved in the dielectric fluid and has a $1^{st}$ electron excitation energy within the range of from 1 to 4 eV which is lower than the $1^{st}$ electron excitation energy of the dielectric fluid.

2. The apparatus of claim 1, wherein the additive is selected from azo compounds, of formula (I):

$$R^5—N=N—R^6 \quad (I)$$

wherein $R^5$ and $R^6$ are both independently selected from aryl or heteroaryl, which is unsubstituted or substituted in one, two or three positions with substituents independently selected from $C_{1-10}$ alkyl, $C_{2-10}$ alkynyl, OH, CHO, $C_{1-10}$ acyl, $C_{1-10}$ alkoxy, $C_{1-6}$ alkanoyloxy, $C_{1-10}$ alkylthio, $C_{1-10}$ alkylamino, CN, nitro, amino, amido, sulfonyl, arylsulfonyl, halo, halo $C_{1-10}$ alkyl, $C_{1-10}$ alkyl aryl, and aminoaryl; or a five-membered carbocyclic or heterocyclic ring, which is unsubstituted or substituted in one, two or three positions with substituents independently selected from $C_{1-10}$ alkyl, $C_{2-10}$ alkynyl, OH, CHO, $C_{1-10}$ acyl, $C_{1-10}$ alkoxy, $C_{1-6}$alkanoyloxy, $C_{1-10}$ alkylthio, $C_{1-10}$ alkylamino, CN, nitro, amino, arylamino, amido, sulfonyl, arylsulfonyl, halo, halo-$C_{1-10}$ alkyl $C_{1-10}$ alkyl aryl, and aminoaryl.

3. The apparatus of claim 1, wherein the dielectric fluid is an ester-based dielectric fluid.

4. The apparatus of claim 1, wherein the additive is selected from the group consisting of colour dyes.

5. The apparatus of claim 2, wherein $R^5$ is selected from phenyl, 2-oxazolyl, 2-thiazolyl and 2-imidazolyl; and $R^6$ is selected from phenyl and 2-thiazolyl.

6. An apparatus selected from the group consisting of electrical apparatuses and power applications, comprising a liquid electrically insulating composition comprising a dielectric fluid and an additive in a concentration of between 1 and 10 wt % of the composition, wherein the additive is dissolved in the dielectric fluid and has a $1^{st}$ electron excitation energy within the range of from 1 to 4 eV which is lower than the 1st electron excitation energy of the dielectric fluid, and wherein the additive is selected from formula (II), (III) and (IV), (II)

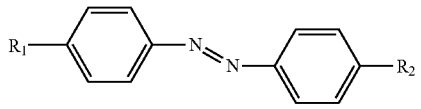

(III)

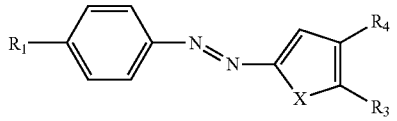

(IV)

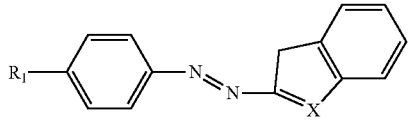

wherein

X is selected from S, O and N; and $R_1$, $R_2$, $R_3$, and $R_4$, are each independently selected from H, $C_{1-10}$ alkyl, CH═$CH_2$, halogens, OH, $C_{1-10}$ alkoxy, OCH—$C_{1-10}$ alkyl, CN, and $NH_2$.

7. The apparatus of claim 6, wherein

X is selected from S and O;

$R_1$ is selected from H, $C_{1-4}$ alkyl, OH, $C_{1-4}$ alkoxy, CN, and $NH_2$;

$R_2$ is selected from H or CN;

$R_3$ is selected from H, CHO, CH═$CH_2$; and $R_4$ is selected from H and Cl.

8. The apparatus of claim 7, wherein $R_1$ is selected from H, CN, $CH_3$, OH, $OCH_3$, and $NH_2$.

9. An apparatus selected from the group consisting of electrical apparatuses and power applications, comprising a liquid electrically insulating composition comprising a dielectric fluid and an additive in a concentration of between 1 and 10 wt % of the composition, wherein the additive is dissolved in the dielectric fluid and has a 1st electron excitation energy within the range of from 1 to 4 eV which is lower than the 1st electron excitation energy of the dielectric fluid, and wherein the additive is of the following formula (V)

(V)

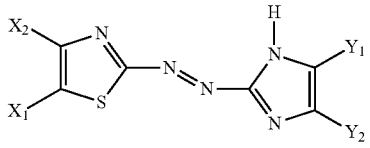

wherein $X_1$, $X_2$, $Y_1$ and $Y_2$ are each independently selected from H, $C_{1-10}$ alkyl, $C_{2-10}$ alkenyl, $C_{2-10}$ alkynyl, OH, CHO, $C_{1-10}$ acyl, $C_{1-10}$ alkoxy, $C_{1-6}$ alkanoyloxy, $C_{1-10}$ alkylthio, $C_{1-10}$ alkylamino, CN, nitro, amino, amido, sulfonyl, arylsulfonyl, halo, halo $C_{1-10}$ alkyl, $C_{1-10}$ alkyl aryl, and aminoaryl.

10. An apparatus selected from the group consisting of electrical apparatuses and power applications, comprising a liquid electrically insulating composition comprising a dielectric fluid and an additive in a concentration of between 1 and 10 wt % of the composition, wherein the additive is dissolved in the dielectric fluid and has a 1st electron excitation energy within the range of from 1 to 4 eV which is lower than the 1st electron excitation energy of the dielectric fluid, and wherein the additive is selected from 4-anilino-4'-nitroazobenzene and p-dimethylamino-azobenzenesulfonic acid.

* * * * *